US008899951B2

(12) United States Patent
Friedrich

(10) Patent No.: US 8,899,951 B2
(45) Date of Patent: Dec. 2, 2014

(54) DISPLACEMENT PUMP WITH SUCTION GROOVE

(75) Inventor: Kim Boris Friedrich, Ilshofen-Gaugshausen (DE)

(73) Assignee: Schwabische Huttenwerke Automotive GmbH, Aalen-Wasseralfingen (DE)

( * ) Notice: Subject to any disclaimer, the term of this patent is extended or adjusted under 35 U.S.C. 154(b) by 285 days.

(21) Appl. No.: 13/190,518

(22) Filed: Jul. 26, 2011

(65) Prior Publication Data

US 2012/0020825 A1 Jan. 26, 2012

(30) Foreign Application Priority Data

Jul. 26, 2010 (DE) ..... 10 2010 038 430

(51) Int. Cl.

| | |
|---|---|
| ***F01C 1/18*** | (2006.01) |
| ***F04C 14/18*** | (2006.01) |
| ***F04C 2/18*** | (2006.01) |
| *F04C 14/26* | (2006.01) |

(52) U.S. Cl.

CPC ..... *F04C 14/185* (2013.01); *F04C 14/26* (2013.01); *F04C 2/18* (2013.01)

USPC ..... 418/205; 418/206.14; 418/206.9

(58) Field of Classification Search

USPC ..... 418/9, 16, 21, 205, 206.1, 206.9; 123/196 R, 198 C

See application file for complete search history.

(56) References Cited

U.S. PATENT DOCUMENTS

| | | | | |
|---|---|---|---|---|
| 2,526,830 | A * | 10/1950 | Purcell | 417/323 |
| 4,740,142 | A | 4/1988 | Rohs | |
| 7,544,052 | B2 * | 6/2009 | Wockel et al. | 418/21 |
| 2004/0191103 | A1 | 9/2004 | Gotschhofer | |
| 2007/0009372 | A1 | 1/2007 | Wockel et al. | |
| 2007/0248481 | A1 * | 10/2007 | Lamparski | 418/206.1 |
| 2009/0041605 | A1 * | 2/2009 | Lamparski et al. | 418/206.1 |

FOREIGN PATENT DOCUMENTS

| | | | | |
|---|---|---|---|---|
| DE | 10 2008 025 346 | A1 | 12/2009 | |
| DE | 102008025346 | A1 * | 12/2009 | F01M 1/16 |

OTHER PUBLICATIONS

German Office Action for DE 102010038430.5 dated Mar. 4, 2011.

EPO Search Report for Application No. EP 11 17 3969 mailed Apr. 25, 2013.

* cited by examiner

*Primary Examiner* — Thomas Denion
*Assistant Examiner* — Thomas Olszewski
(74) *Attorney, Agent, or Firm* — RatnerPrestia

(57) ABSTRACT

A displacement pump, including a pump chamber and a regulating chamber which are separated from each other by a piston, wherein the pump has a device with which fluid flowing from the pump chamber toward the regulating chamber can be drained.

15 Claims, 3 Drawing Sheets

DISPLACEMENT PUMP WITH SUCTION GROOVE

RELATED APPLICATION DATA

This application claims the priority of German patent application No. 10 2010 038 430.5-15, filed on Jul. 26, 2010, which is hereby incorporated in its entirety by reference.

FIELD OF THE INVENTION

The invention is directed to a displacement pump and/or a positive-displacement pump having an adjustment device for its specific displacement volume. The pump comprises at least two pivotably mounted conveying wheels and/or displacement wheels which are in conveying and/or displacing engagement with one another in order to convey and/or displace a working fluid under a pressure increase from a low-pressure side of the pump to a high-pressure side of the pump during rotary driving of at least one of the displacement wheels. The invention is furthermore directed to a system comprising the pump for supplying an aggregate and/or a power unit with a working or lubricating fluid. In preferred applications, the pump serves to supply a combustion engine with lubricating oil, i.e. in this application, it constitutes the lubricating oil pump of the motor. The displacement volume of the pump in relation to the rotational speed of one of the displacement wheels [displacement volume/rotational speed] is understood as the specific displacement volume.

BACKGROUND OF THE INVENTION

Displacement pumps are known in which one of the displacement wheels disposed in a pump chamber is shiftable and/or translationally movable along its rotational axis and relative to the other of the displacement wheels for adjusting the volume flow. To this end, a piston is disposed on a frontal side of the displacement wheel which is shiftable together with the displacement wheel and forms a sealing gap on a circumferential side together with an enclosure for the piston. On the side of the piston facing away from the displacement wheel, a regulating chamber is disposed in which a means for generating a shifting movement of the piston is disposed.

With this arrangement, the problem often occurs that a pressure fluid present in the pump chamber flows via the sealing gap into the regulating chamber. This leakage of the sealing gap can lead to more or less significant problems in controlling the pump.

SUMMARY OF THE INVENTION

One aspect of the invention is to provide a displacement pump, in particular a gear pump and/or toothed wheel pump or external gear pump, which is controllable in an even better way.

The invention proceeds from a displacement pump, in particular a gear pump or external gear pump.

The pump comprises a pump chamber and a regulating chamber which are separated from one another by a shiftable piston. In the pump chamber, a first displacement wheel and a second displacement wheel are disposed, wherein the displacement wheels are preferably gear wheels and/or cog wheels and/or pinions and are in engagement with one another. In particular, the gear wheels mesh at a meshing location, i.e. the teeth of the gear wheels engage one another at said location. The gear wheels can have an evolvent or cycloid tooth shape or another shape which is familiar to the skilled person. The piston is preferably axially shiftable, i.e. shiftable along a rotational axis of one of the displacement wheels, in particular the displacement wheel which is shiftable together with the piston. It is possible for only a first displacement wheel and a second displacement wheel to be disposed in the pump chamber, whereby in particular only a single meshing location is formed. Alternatively, however, embodiments are also possible in which a third displacement wheel is disposed in the pump chamber in addition to the first displacement wheel and the second displacement wheel and is in engagement with either the first displacement wheel or the second displacement wheel, whereby the third displacement wheel can form another meshing location with the first or the second displacement wheel.

The pump chamber comprises a suction space on a suction side and a pressure space on a pressure side which are separated from one another by the mutually engaging displacement wheels. A feed opening leads into the suction space, wherein fluid to be conveyed and/or displaced may be fed from outside the pump chamber into the pump chamber through said feed opening. A discharge opening and/or drain opening leads into the pressure space, wherein fluid to be conveyed and/or displaced can be conveyed and/or displaced from the pump chamber, for example to the lubricating spots of an aggregate, in particular a motor, through said drain opening. During the displacing operation, the pressure in the suction space is less than in the pressure space. Per engagement of mutually engaging displacement rims, a suction space and a pressure space can be formed.

In embodiments having only a first displacement wheel and a second displacement wheel, these can engage one another, wherein only one suction space and only one pressure space is formed. In embodiments having a first, second and third displacement wheel, these can engage one another at two locations, such that one suction space and one pressure space are formed per engagement. For example, the first displacement wheel can be in engagement with the second displacement wheel and the second displacement wheel with the third displacement wheel. The two pressure spaces may be fluidically separated or interconnected. The same may apply to the two suction spaces. The advantage of interconnected suction spaces or pressure spaces is that the displacement flow and/or conveyance flow for a fluid-guiding system can be increased, in particular doubled. The advantage of separated suction spaces or/and pressure spaces is that several, in particular two, fluid circuits which can be separated from one another or connected to one another can be supplied by a single pump. The circumferential section of the displacement wheel which is in engagement with the other two displacement wheels may, in a circumferential direction between the locations of engagement, lead into a suction space and a pressure space. This displacement wheel can in particular have two of these sections. The suction space located on one side can be separated from the pressure space located on the same side, for example by means of a wall which embraces the second displacement wheel over a part of the circumference and forms a sealing gap with this part of the circumference. This enables fluid to be displaced from the suction space to the pressure space located on the other side at a first volume flow and to the pressure space located on the same side at a second volume flow.

The displacement wheels are embraced—in relation to the respective rotary axes—opposite the meshing location along a part of their circumference by a wall, in particular a cylindrical wall, of the pump chamber. In particular, the outer diameters of the gear wheels form a sealing gap with the walls which embrace parts of the gear wheels. For displacement, the displacement wheels are rotatable at their meshing location in the direction of the suction space. The fluid flowing into the tooth spaces of the gear wheels in the suction space is taken along in the tooth spaces and conveyed along the embracing wall to the pressure side, in particular into the pressure space. The engagement of the displacement wheels at the meshing location prevents the fluid from flowing back. This creates an underpressure on the suction side, in particular in the suction space, and an overpressure on the pressure side, in particular in relation to the ambient pressure.

One of the displacement wheels is rotationally driven via a drive device such as for example a motor or the motor to be lubricated or its crankshaft, wherein it picks up the other displacement wheel. Preferably, the driving displacement wheel is disposed axially fixed in the pump. The displacement wheel picked up by the driving displacement wheel can be shifted along its rotational axis, in particular back and forth. If present, the picked-up displacement wheel can pick up another displacement wheel which is preferably disposed axially fixed in the pump. In such an embodiment having a first, second and third displacement wheel, the shiftable displacement wheel is preferably the one which is in engagement with the other two displacement wheels, such as for example the first and the third displacement wheels. At maximum axial coverage and/or overlap of the shiftable displacement wheel with the other displacement wheel or wheels, the pump can displace and/or convey the maximum volume flow. The volume flow can be reduced by shifting one displacement wheel relative to the other wheel or wheels far enough that the axial coverage is decreased. At minimum overlap and/or coverage of the displacement wheels, the pump can displace and/or convey its minimum volume flow. By shifting at least one of the displacement wheels, the volume flow or displacement flow of the pump is adjustable. The shiftable displacement wheel is connected to the piston axially fixed. Shifting the piston causes the displacement wheel to be shifted and/or translationally moved. The regulating chamber has a wall, preferably a cylindrical wall, in which the piston, which is also preferably cylindrical, is received in a longitudinally shiftable manner. The outer circumference of the piston forms a sealing gap with the inner circumference of the regulating chamber. The sealing gap is dimensioned such that the piston is axially shiftable. Though the sealing gap substantially seals the pump chamber with regard to the regulating chamber, a certain tolerance and/or clearance between the piston and the wall, which allows for a certain leakage in the sealing gap, is however necessary due to the required ability of the piston to shift longitudinally. This leakage enables the fluid to flow out of the pump chamber, in particular out of the pressure area, toward the regulating chamber.

In the regulating chamber, a means is disposed which can generate a translational force and/or shifting force for the piston. For example, this means can be a spring, a motor or in general an actuator. Preferably, this means is a fluid, such as for example oil, which exhibits a pressure, in particular a varying pressure, which is preferably less than the pressure of the fluid to be displaced and/or conveyed, in particular the oil on the pressure side, and is greater than the pressure of the fluid to be displaced and/or conveyed on the suction side.

For regulating the volume flow, it can be undesirable for fluid to flow from the pump chamber to the regulating chamber because this could disturb exact regulation of the pump.

The pump according to the invention therefore has a device with which fluid flowing out of the pump chamber toward the regulating chamber can be drained, preferably toward the suction side. Thus, no fluid can flow out of the pump chamber into the regulating chamber, despite a certain leakage in the sealing gap between the piston and the piston guide or piston guide wall, because it is discharged or removed from the sealing gap before reaching the regulating chamber. Preferably, the fluid flowing toward the regulating chamber is guided or drained to or toward the suction side of the pump. To this end, a pressure is preferably present in the device which is lower than the pressure of the fluid on the pressure side of the pump chamber and preferably also lower than the pressure of the fluid in the regulating chamber. For example, the suction side fulfills the requirements for the low pressure. In particular, the suction side of the pump is connected to the device fluidically, i.e. in a manner capable of guiding fluid or hydraulically. The fluid to be drained can thus be sucked to or toward the suction side. Preferably, the device comprises a channel which is disposed in the region in which the piston forms the sealing gap with the piston guide which surrounds the piston, in particular the wall of the regulating chamber. The channel could in principle be disposed in the wall of the regulating chamber. Preferably, the channel is disposed in the piston between the pump and the regulating chamber. In general, it is preferred if the channel is open toward the sealing gap.

The channel can be disposed between the frontal sides of the piston, in particular approximately in the middle. Preferably, the sealing gap extends from the channel toward the pump chamber and the regulating chamber. The channel can be formed by a groove or a cut-in in the piston or the wall surrounding the piston.

The channel extends at least partly, preferably completely, or annularly along the circumference of the sealing gap. If the channel is disposed only partly along the circumference, it can preferably be disposed at a circumferential position which is in the region of the pressure side of the pump chamber.

The channel can be connected, in particular fluidically, to the suction side or to another region which exhibits a lower pressure than the pressure side and/or the regulating chamber. In particular, a fluid-guiding section can lead into the channel which leads to the suction side or the side with the lower pressure, in particular into the pump chamber, or/and connects the suction side or the suction space, in particular fluidically, to the channel. The fluid-guiding section preferably also leads to the suction side or the suction space. The fluid-guiding section can be closed or open toward the sealing gap. The fluid-guiding section can also extend approximately in parallel or at least in the direction of the rotational axis of the axially shiftable gear wheel.

The pressure for the fluid present in the regulating chamber is preferably collected at the high-pressure side of the pump or after the pump. In principle, this pressure could be collected at the pressure space of the pump chamber. Preferably, the pressure is collected at a location on the pressure side at which the fluid pressure corresponds as precisely as possible to the fluid pressure of a consumer load and/or appliance to be supplied with the fluid by the pump. If the consumer load is for example the motor, in particular a piston engine of a motor vehicle, then the fluid pressure is preferably the pressure of the so-called main gallery, i.e. the channel from which the channels for the individual lubricating spots for the crankshaft and/or the cam shaft branch off. Preferably, the piston forms a shiftable wall for the regulating chamber, wherein the regulating chamber can be loaded with the gallery pressure.

A valve, in particular a 3/2 directional regulating valve, is in particular disposed in the fluid-guiding section between the gallery and the regulating chamber, wherein the regulating chamber may be optionally connected in a fluid-guiding manner to the gallery or a supply reservoir by said valve. Optionally, a valve can be used which has the same functions as a 3/2 directional regulating valve but also has an additional switching position in which the valve is in a shut-off position and/or blocking position, i.e. an inward flow of the fluid into the regulating chamber and an outward flow of the fluid out of the regulating chamber is blocked. An example of this is a 4/3 directional regulating valve.

In preferred embodiments, the translational movement and/or shift of the piston can at least be supported by a spring element. The spring can for example be disposed such that if regulation fails, such as for example the regulating valve, the spring adjusts the pump to a position for maximum volume flow by shifting and/or translationally moving the piston and the shiftable displacement wheel.

The pump can also have another piston which is disposed on the opposite side of the displacement wheel to the piston for the regulating chamber. In the following, the piston for the regulating chamber is referred to as the regulating piston, and the piston lying opposite is referred to as the pressure piston. The pressure piston, the regulating piston and the displacement wheel can be shiftable and/or displaceable as a unit. The pressure piston can lie against a wall surrounding it, in particular a pressure chamber wall, in a sealing manner and form a sealing gap. In principle, the pressure piston can alternatively or additionally have a device with which fluid flowing from the pump chamber toward the pressure chamber can be drained and/or discharged. The explanations for the design of the fluid-draining device for the regulating piston correspondingly apply to the pressure piston.

At the circumference of the pressure piston, a groove can be disposed which is provided as an alternative to or in addition to the fluid-draining device. The groove is positioned such that it connects the pressure space to the suction space at the minimum overlap of the displacement wheels or the minimum volume flow of the pump, respectively, whereby the groove, which can also be referred to as a short-circuit groove, can act in the manner of a bypass which further de-regulates the pump at a minimum volume flow to be displaced, by guiding fluid from the pressure space back into the suction space via the groove. In the position for minimum volume flow, the groove can lead toward the non-shiftable displacement wheel, i.e. for example the first displacement wheel. At positions of the pressure piston outside of the position for minimum displacement flow, the groove can be sealed by the wall surrounding the pressure piston, in particular in relation to the pressure space and the suction space.

The pressure piston preferably exhibits a cross-section which is not rotationally symmetrical. In particular, the pressure piston exhibits a circular and/or round cross-section with a circular recess which extends from the rim and/or boundary of the circular cross-section toward the center point, but not up to the center point. The cross-sectional area, in particular the area of the frontal side of the pressure piston, is smaller than the cross-sectional area of the regulating piston. The pressure piston can be loaded by a motor or a spring. Preferably, the pressure piston is pressure-loaded by a fluid, in particular an oil, which in particularly preferred embodiments is collected on the pressure side of the pump or after the pump. In this case, too, it is preferable for the pressure to be collected from the gallery or main gallery of the motor. Generally, a fluid-guiding section which leads into the pressure chamber and/or regulating chamber can be provided for collecting the pressure.

The recess of the pressure piston can preferably exhibit a distance from the center point of the cross-section which corresponds to the difference of the distance of the axes of the first and second displacement wheels and the outer diameter of the first displacement wheel.

Preferably, the fluid of the regulating chamber and in particular also the fluid of the pressure chamber is from the same fluid-displacing system and/or fluid-conveying system as the fluid of the pump chamber, or the pump chamber and the regulating chamber and optionally the pressure chamber are connected to one another in a fluid-guiding manner.

The invention is also directed to a system for supplying an aggregate, preferably a piston combustion engine, with a working fluid or lubricating fluid, wherein the system comprises the displacement pump and the aggregate.

BRIEF DESCRIPTION OF THE DRAWINGS

The invention has been described by way of several embodiments. In the following, a particularly preferred embodiment is described by way of figures. The features thus disclosed advantageously develop the invention, in particular also together with the features described above.

DETAILED DESCRIPTION

Figure 1:
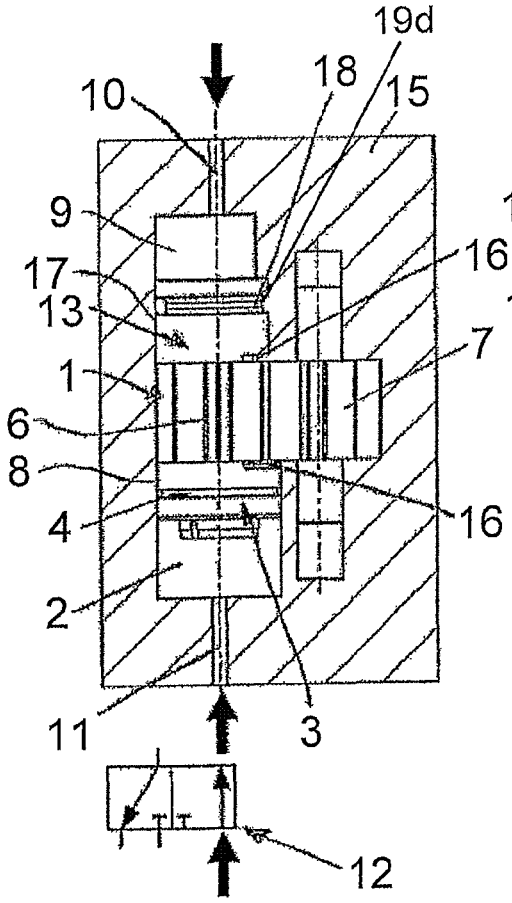
FIG. 1 shows a schematic sketch of a displacement pump according to the invention, in an arrangement at a maximum volume flow.
Figure 2:
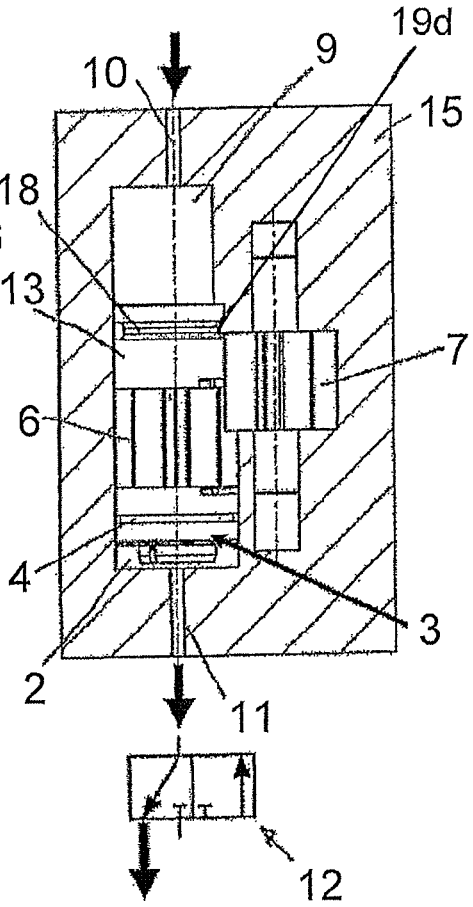
FIG. 2 shows the sketch of FIG. 1, at a minimum volume flow.

FIGS. 1 and 2 show an external gear wheel pump having a first gear wheel 7 and a second gear wheel 6. The first gear wheel 7 is driven by a drive such as for example the crankshaft of a motor (not shown). Because the first gear wheel 7 is in a meshing engagement with the second gear wheel 6, the second gear wheel 6 is picked up by the rotational motion of the first gear wheel 7. The first and second gear wheels 6, 7 rotate in opposite rotational directions, such that their pitch circle diameters roll off on one another at their meshing location.

The first gear wheel 7 is axially framed by a wall of the housing 15 on both frontal sides which form a sealing gap with the housing 15. The first gear wheel 7 is embraced by a wall of the housing 15 along a part of the circumference. The outer diameter of the first gear wheel 7 or the outer surfaces of the tooth tips, respectively, form a sealing gap with the housing 15.

The second gear wheel 6 is also embraced along a part of its circumference by the housing 15, whereby the outer diameter of the second gear wheel 6, in particular the outer surfaces of its tooth tips, form a sealing gap with the housing 15. The second gear wheel 6 is rotatably mounted on a shaft which connects a regulating piston 3 and a pressure piston 13 at a defined distance from one another which corresponds approximately to the width of the second gear wheel 6 plus the thicknesses of the sealing gaps which the frontal sides of the second gear wheel 6 form with the regulating piston 3 and the pressure piston 13.

The housing 15 and the pistons 3, 13 form a pump space 1. Below the meshing location of the two gear wheels 6, 7, a suction space is formed in the pump space, and above the meshing location, a pressure space is formed in the pump space. The pump has connectors for feeding lubricating oil to the suction space and for draining the lubricating oil from the pressure space toward the motor.

The regulating piston 3 exhibits a circular cross-section and is received in a shiftable and/or translationally movable manner in a regulating chamber 2. The outer circumference of the cylindrical regulating piston 3 forms a sealing gap 8 with the correspondingly cylindrical inner circumference of the regulating chamber 2. The diameter of the regulating piston 3 corresponds approximately to the outer diameter of the second gear wheel 6.

On the opposite side of the second gear wheel 6 to the regulating piston 3, a pressure piston 13 is located which is disposed in a pressure chamber 9 such that it can be shifted along the rotational axis of the second gear wheel 6. The outer circumference of the pressure piston 13 forms a sealing gap 17 with the wall of the pressure chamber 9. The pressure piston 13 is cylindrical over the majority of its circumference and exhibits an outer diameter which corresponds approximately to the outer diameter of the second gear wheel 6. The pressure piston 13 also has a partly cylindrical recess 14 having a radius which corresponds approximately to the radius of the outer diameter of the first gear wheel 7, wherein the recess 14 extends from the circumferential side toward the central axis of the piston 13. The distance between the recess 14 and the central axis of the pressure piston 13 or the rotational axis of the second gear wheel 6 approximately equals the distance between the rotational axes of the first and second gear wheels 6, 7 minus the radius of the outer diameter of the first gear wheel 7. The recess 14 allows the unit consisting of the pressure piston 13, the second gear wheel 6 and the regulating piston 3, which is illustrated separately in FIGS. 3 and 4, to be moved from the maximum displacement position shown in FIG. 1, in which the first and second gear wheels 6, 7 are in complete axial overlap, to a minimum displacement position shown in FIG. 2, in which the first and second gear wheels 6, 7 only partially overlap axially. In the position shown in FIG. 2, the recess 14 forms a sealing gap with the outer diameter and/or the outer surfaces of the tooth tips of the first gear wheel 7.

Figure 3:
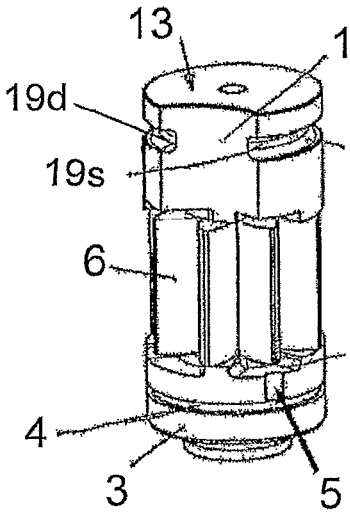
FIG. 3 shows a regulating unit for the apparatus of FIGS. 1 and 2.
Figure 4:
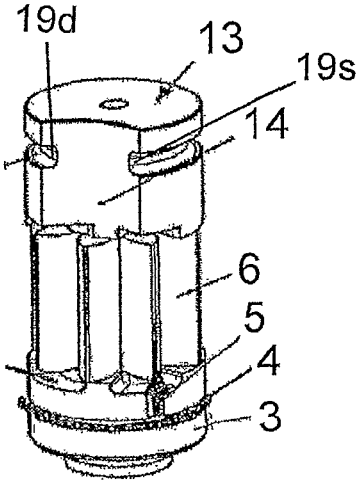
FIG. 4 shows the regulating unit of FIG. 3, showing the effect of the device for draining the fluid.

The pressure piston 13, in particular its cylindrical outer diameter, has a groove 18 which can also be referred to as a short-circuit groove or bypass channel. The groove 18 extends in a circumferential direction of the cylindrical section of the pressure piston 13. The groove 18 is sealed on a circumferential side by the wall which forms the sealing gap 17 with the pressure piston 13, as may be seen from FIGS. 1 and 2. On both sides of the groove 18, the cylindrical outer diameter of the pressure piston 13 forms a sealing gap 17 with the wall. The wall is formed by the housing 15. The groove 18 opens toward the recess 14 with openings 19*d*, 19*s* (FIGS. 3 and 4). The openings 19*d*, 19*s* are disposed such that one of these openings 19*d* may be shifted into the pressure space and the other of the openings 19*s* may be shifted into the suction space. In most of the displacement positions, in particular in the maximum displacement position of the second gear wheel 6, the openings 19*d*, 19*s* are sealed by the wall of the housing 15 which guides the piston 13 (FIG. 1). In the position of the second gear wheel 6 for a minimum volume flow, the pressure piston 13 is translationally moved and/or shifted far enough that the groove 18, in particular its openings 19*d*, 19*s*, are out of the seal with the housing 15, whereby the openings 19*d*, 19*s* open toward the first gear wheel 7. One of the openings 19*d* opens into the pressure space, the other 19*s* into the suction space. Thus, in the position of the pump for a minimum volume flow, fluid can flow out of the pressure space back into the suction space via the groove 18. The volume flow displaced by the pump can thus be reduced even further.

The pressure piston 13 and the regulating piston 3 have relieving pockets 16 and/or load-relieving pockets 16 at their frontal sides pointing toward the second gear wheel 6 which ensure a better pressure distribution in the oil during the displacement operation.

The pressure chamber 9 is preferably permanently loaded with a pressure which corresponds to the pressure from the main gallery of the motor. To this end, the main gallery of the motor is connected to a feed 10 or the pressure chamber 9, respectively, in a fluid-guiding manner. The fluid or oil, respectively, contained in the pressure chamber 9 exerts a force on the pressure piston 13 which is dependent on the frontal surface of the pressure piston 13 pointing toward the pressure chamber 9. Preferably, the pressure chamber 9 is permanently loaded with the pressure from the main gallery of the motor.

The regulating chamber 2 is also loadable with a pressure, preferably the pressure from the main gallery of the motor. The amount of fluid contained in the regulating chamber or the pressure can be varied by means of the feed 11. Fluid can be fed to or drained from the regulating chamber 2 by means of the feed 11. Feeding and draining fluid can be controlled by means of a valve 12, which in the example shown has three connectors and two switching positions and can therefore be referred to as a 3/2 directional regulating valve. The regulating chamber 2 is connectable to the main gallery (FIG. 1) or a supply reservoir (FIG. 2) in a fluid-guiding manner via the valve 12.

If the pressure chamber 9 and the regulating chamber 2 are each loaded with the pressure of the main gallery, the unit shown in FIG. 3 is shifted and/or translationally moved into the position shown in FIG. 1, because the frontal surface of the regulating piston 3 pointing toward the regulating chamber 2 is greater than the frontal surface of the pressure piston 13 pointing toward the pressure chamber 9, whereby the fluid of the regulating chamber 2 exerts a greater force on the unit 3, 6, 13 shown in FIG. 3 than the fluid of the pressure chamber 9. If the valve 12 is switched such that the regulating chamber 2 is connected in a fluid-guiding manner to a supply reservoir—as is generally preferred, the oil pan—instead of to the main gallery, the permanently applied pressure of the pressure chamber 9 can shift and/or translationally move the unit shown in FIG. 3 into the position shown in FIG. 2, wherein the oil contained in the regulating chamber 2 is guided into the supply reservoir.

Because a higher pressure is present in the pump chamber 1, in particular in the suction space, than in the regulating chamber 2, oil is pressed out of the pump chamber 1 toward the regulating chamber 2 via the sealing gap 8. This leakage oil can be detrimental to regulating the pump. A channel which is open toward the sealing gap 8 is therefore introduced into the regulating piston 3 in accordance with the invention. The channel 4 is disposed such that a sealing gap is located between it and each of the frontal sides of the regulating piston 3. In particular, the channel 4 can be disposed approximately in the middle between the two frontal sides. The channel 4 runs annularly along the circumference, in particular the whole circumference, of the cylindrical regulating piston 3.

The channel 4 is connected to the pump chamber 1, in particular to the suction space or the suction side, by means of a fluid-guiding section 5. The leakage oil which flows via the sealing gap 8 is caught by means of the channel 4 and guided into the pump chamber 1 via the fluid-guiding section 5. The fluid-guiding section 5 shown in FIG. 3 extends approximately parallel to the rotational axis of the second gear wheel 6 and is open toward the sealing gap 8. As may be seen from FIG. 3, the fluid-guiding section 5 advantageously leads into one of the relieving pockets 16. In the relieving pocket 16, which is in particular disposed in the suction region, a relatively constant pressure is present, i.e. the pressure fluctuations exerted on the fluid by the gearing and/or cogging of the rotating displacement wheel 6 are less intense and/or are reduced.

Figure 5B:
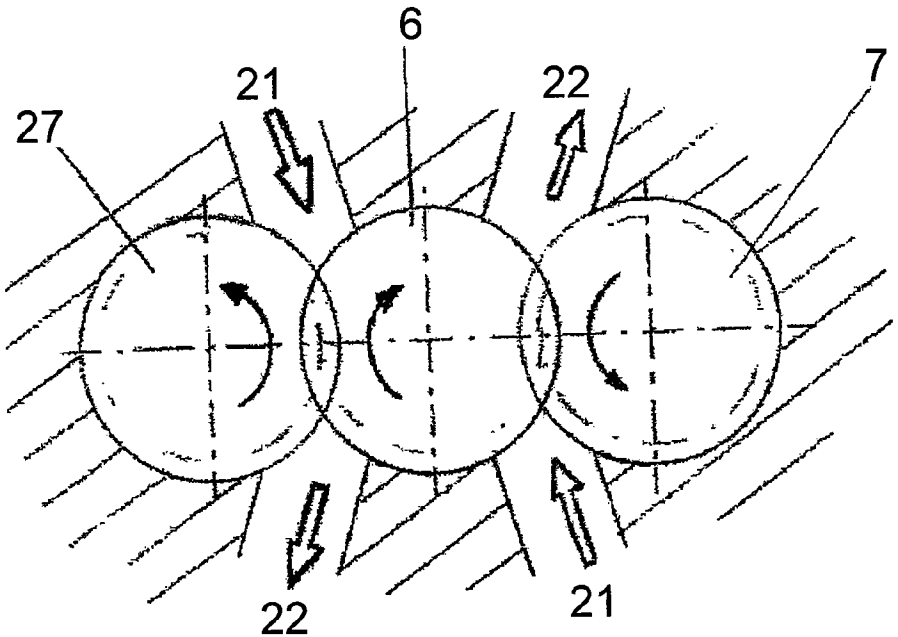
FIGS. 5A and 5B shows a schematic sketch of another embodiment of a displacement pump according to the invention, in a side view and a plan view.
Figure 5A:
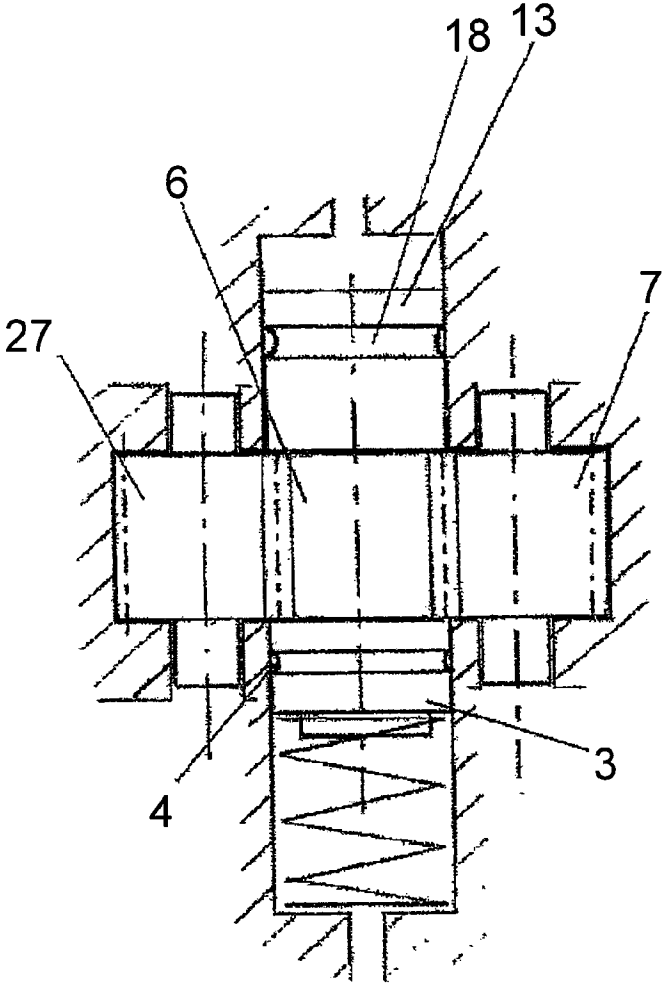

In FIGS. 5A and 5B, another embodiment of the invention is shown. The pump comprises a third gear wheel 27 in addition to the first gear wheel 7 and the second gear wheel 6. The second gear wheel 6 is in a meshing engagement with both the first gear wheel 7 and the third gear wheel 27. As can best be seen in the side view in FIG. 5A, a suction space and a pressure space are formed at each meshing location which are separated from one another by the meshing location, i.e. lie opposite one another. A pressure space is situated at the location at which the teeth of the gear wheels 6, 7, 27 enter the meshing location; a suction space is situated at the location at which they exit the meshing location. A pressure space is also disposed next to the suction space, and these are separated from each other without a meshing location, such as for example by means of a wall which forms a sealing gap with the circumference of the gear wheel 6.

Fluid can be conveyed by the mutually meshing gear wheels 6, 27; 6, 7 from a suction space both to the pressure space lying opposite and to the pressure space disposed adjacent to it. For example, fluid is displaced from the suction space which leads onto the meshing location of the second and third gear wheels 6, 27, in one partial flow via the third gear wheel 27 to the pressure space lying opposite which leads onto the meshing location of the gear wheels 6, 27, and in another partial flow via the second gear wheel 6 to the adjacently situated pressure space which leads onto the meshing location of the first and second gear wheels 6, 7. The same principle is applicable to the fluid of the suction space which leads onto the meshing location of the gear wheels 6, 7, i.e. one partial flow is conveyed via the first gear wheel 7 to the pressure space lying opposite which leads onto the meshing location of the gear wheels 6, 7, and one partial flow is conveyed via the second gear wheel 6 to the pressure space situated adjacent to it which leads onto the meshing location of the gear wheels 6, 27.

The first gear wheel 7 and the third gear wheel 27 can be received in the housing, substantially axially fixed, while the second gear wheel 6 is axially shiftable and/or translationally movable relative to the first and third gear wheels 7, 27, as is indicated in the plan view of FIG. 5B by the direction of the arrow. For the embodiment of FIGS. 5A and 5B, in particular the design of the regulating piston 3 including the channel 4 and the pressure piston 13 including the groove 18, reference is made to the description of FIGS. 1 to 4. However, the pressure piston 13 has been altered as compared to the embodiment shown in FIGS. 1 to 4. Due to the additional third gear wheel 27, the pressure piston 13 has two recesses which lie opposite each other and are designed like the recess 14 of FIGS. 3 and 4. The pressure piston 13 has a recess 14 for the first gear wheel 7 and, opposite it on the circumference, another, second recess for the third gear wheel 27. In the position for the minimum displacement flow, the openings 19 of the grooves 18 lead into the suction and pressure spaces disposed next to one another. For example, fluid can be drained from the pressure space leading onto the meshing location 6, 7 to the suction space leading onto the meshing location 6, 27 via the groove 18. Fluid from the pressure space leading onto the meshing location 6, 27 can be drained into the suction space leading onto the meshing location 6, 7 via another groove 18. By guiding the fluid of the pressure spaces back, the displacement flow of the pump can be reduced.

Figure 7:
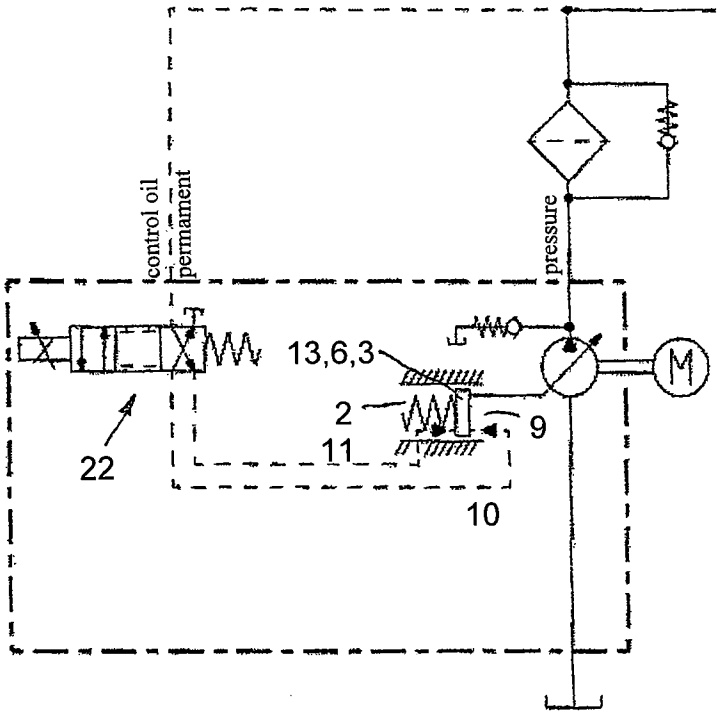
FIG. 7 shows a connection scheme using a regulation comprising a 4/3 directional regulating valve.
Figure 6:
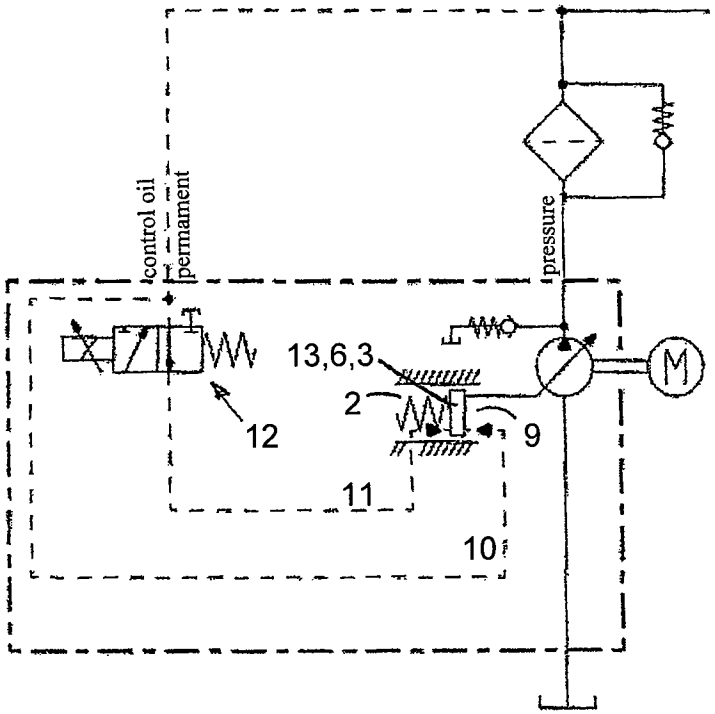
FIG. 6 shows a connection scheme using a regulation comprising a 3/2 directional regulating valve.

FIG. 6 shows a connection scheme with a 3/2 directional regulating valve 12 and one of the pumps described herein. In FIGS. 6 and 7, the unit consisting of the pressure piston 13, the second gear wheel 6 and the regulating piston 3 is shown as a shiftable and/or translationally movable wall which is loaded with a force by a spring which is disposed in the regulating chamber 2 and acts as a compression spring. In the absence of an external force, the spring presses the unit 13, 6, 3 into the position for a maximum volume flow (FIG. 1). In the switching position shown in FIG. 6, the unit 13, 6, 3 is pressed into the position for the maximum volume flow in addition to the spring force, on the one hand due to the spring force and on the other hand due to the cross-sectional area of the regulating piston 3 which is enlarged as compared to the pressure piston 13. The pressure chamber 9 is loaded via the feed 10 with the same pressure as the regulating chamber 2. By for example electrically and/or magnetically activating the valve 12, the latter is moved into its second switching position against the pressure of a return spring, whereby the fluid of the regulating chamber 2 is guided back into the reservoir such as for example an oil pan. Because the force of the spring in the regulating chamber 2 is less than the pressure force caused by the pressure which is permanently applied to the pressure chamber 9, the unit 13, 6, 3 is shifted and/or translationally moved into the position for minimum volume flow shown in FIG. 2.

FIG. 7 shows a connection scheme with a 4/3 directional regulating valve 22 and one of the pumps described herein. In the first switching position of the valve 22 shown in FIG. 7, the unit 13, 6, 3 is shifted and/or translationally moved into a position for a maximum volume flow due to the force of the spring which is disposed in the regulating chamber 2 and due to the fluid pressure in the regulating chamber 2. The pressure chamber 9 is pressureless and/or depressurized. The fluid of the pressure chamber 9 is guided into the reservoir. In the second switching position, the connectors of the valve 22 are blocked, such that the unit 13, 6, 3 can be blocked for example in an intermediate position between the positions for a maximum and a minimum displacement flow. In the third position of the 4/3 directional regulating valve 22, the unit 13, 6, 3 is pressed into the position shown in FIG. 2 because the force of the spring is less than the pressure force exerted on the unit 13, 6, 3 by the pressure in the chamber 9, wherein the fluid from the regulating chamber 2 is guided into the reservoir.

What is claimed is:

1. A displacement pump, comprising a pump chamber and a regulating chamber which are separated from each other by a piston, wherein the piston comprises a channel and a fluid guiding section, wherein the channel is disposed in a region in which the piston forms a sealing gap with a piston guide which surrounds the piston, wherein the channel is open toward the sealing gap and the fluid guiding section leads into the channel and to a suction side, wherein the suction side is connected to the channel fluidically via the fluid guiding section such that a pressure which is present on the suction side of the pump is also present in the channel such that fluid flowing from the pump chamber via the sealing gap toward the regulating chamber is drained to the suction side.

2. The displacement pump, of claim 1, wherein the displacement pump is a gear pump.

3. The displacement pump of claim 1, wherein the sealing gap extends from the channel toward the pump chamber and the regulating chamber.

4. The displacement pump of claim 1, wherein the fluid-guiding section leads into the pump chamber.

5. The displacement pump of claim 1, wherein the piston forms a translationally movable wall for the regulating chamber, wherein the regulating chamber is adapted to be loaded with a pressure.

6. The displacement pump of claim 1, wherein a valve is disposed in a fluid-guiding section to the regulating chamber and is adapted to load the regulating chamber with a pressure, relieve it of a pressure or connect it to a reservoir in a fluid-guiding manner.

7. The displacement pump of claim 6, wherein the valve is a 3/2 directional regulating valve or a 4/3 directional regulating valve.

8. The displacement pump of claim 1, wherein translationally moving the piston is at least supported by a spring element.

9. The displacement pump of claim 1, further comprising a displacement wheel with which fluid can be displaced from a suction side to a pressure side of the pump and which is coupled to the piston such that an axial shift of the piston causes an axial shift of the displacement wheel.

10. The displacement pump of claim 9, wherein the displacement wheel is a second displacement wheel which is in engagement with at least one other displacement wheel.

11. A system for supplying an aggregate with a working fluid or a lubricating fluid, wherein the system comprises the displacement pump of claim 1.

12. The system of claim 11, wherein the aggregate is a piston combustion engine.

13. A displacement pump, comprising a pump chamber and a regulating chamber which are separated from each other by a piston, wherein the piston comprises a channel and a fluid guiding section, wherein the channel is disposed in a region in which the piston forms a sealing gap with a piston guide which surrounds the piston, wherein the channel is open toward the sealing gap and extends annularly along the circumference of the sealing gap, and the fluid guiding section leads into the channel and to a suction side, wherein the suction side is connected to the channel fluidically via the fluid guiding section such that a pressure which is present on the suction side of the pump is also present in the channel such that fluid flowing from the pump chamber via the sealing gap toward the regulating chamber is drained to the suction side.

14. A displacement pump, comprising a pump chamber and a regulating chamber which are separated from each other by a cylindrical piston, wherein the cylindrical piston comprises a channel and a fluid guiding section, wherein the channel is disposed in a region in which the cylindrical piston forms a sealing gap with a cylindrical piston guide which surrounds the cylindrical piston, wherein the channel is open toward the sealing gap and the fluid guiding section leads into the channel and to a suction side, wherein the suction side is connected to the channel fluidically via the fluid guiding section such that a pressure which is present on the suction side of the pump is also present in the channel such that fluid flowing from the pump chamber via the sealing gap toward the regulating chamber is drained to the suction side.

15. A displacement pump, comprising a pump chamber and a regulating chamber which are separated from each other by a cylindrical piston, wherein the cylindrical piston comprises a channel and a fluid guiding section, wherein the channel is disposed in a region in which the cylindrical piston forms a sealing gap with a cylindrical piston guide which surrounds the cylindrical piston, wherein the channel is open toward the sealing gap and extends annularly along the circumference of the sealing gap, and the fluid guiding section leads into the channel and to a suction side, wherein the suction side is connected to the channel fluidically via the fluid guiding section such that a pressure which is present on the suction side of the pump is also present in the channel such that fluid flowing from the pump chamber via the sealing gap toward the regulating chamber is drained to the suction side.

* * * * *